US012196208B2

(12) United States Patent
Takeda et al.

(10) Patent No.: US 12,196,208 B2
(45) Date of Patent: Jan. 14, 2025

(54) COMPRESSOR

(71) Applicant: DAIKIN INDUSTRIES, LTD., Osaka (JP)

(72) Inventors: Jin Takeda, Osaka (JP); Yoshihiro Shinohara, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 78 days.

(21) Appl. No.: 18/182,685

(22) Filed: Mar. 13, 2023

(65) Prior Publication Data

US 2023/0213035 A1 Jul. 6, 2023

Related U.S. Application Data

(63) Continuation of application No. PCT/JP2021/030744, filed on Aug. 23, 2021.

(30) Foreign Application Priority Data

Sep. 14, 2020 (JP) ..... 2020-153506

(51) Int. Cl.
*F04C 29/12* (2006.01)
*F04C 18/02* (2006.01)

(52) U.S. Cl.
CPC ..... *F04C 29/12* (2013.01); *F04C 18/0215* (2013.01); *F04C 2240/30* (2013.01); *F04C 2240/40* (2013.01)

(58) Field of Classification Search
CPC .. F04C 15/0096; F04C 29/12; F04C 2240/30; F04C 2240/603; F04B 39/123
See application file for complete search history.

(56) References Cited

U.S. PATENT DOCUMENTS 5,240,391 A * 8/1993 Ramshankar ..... F04C 29/045 417/372
5,366,352 A * 11/1994 Deblois ..... F04B 39/066 417/292

FOREIGN PATENT DOCUMENTS

JP 5-180180 A 7/1993
JP 2001-99080 A 4/2001
(Continued)

OTHER PUBLICATIONS

International Preliminary Report of corresponding PCT Application No. PCT/JP2021/030744 dated Mar. 23, 2023.
(Continued)

*Primary Examiner* — Kenneth J Hansen
(74) *Attorney, Agent, or Firm* — Global IP Counselors, LLP

(57) ABSTRACT

A compressor includes a tubular shape casing, a compression mechanism adjacent one end of the casing in the casing, a motor arranged adjacent another end of the casing in the casing, a suction pipe opening between the compression mechanism and the motor, a gas flow path formed between the motor and an inner peripheral surface of the casing, and a gas guide facing an open end of the suction pipe. The gas flow path allows internal regions of the casing adjacent axial ends of the motor to communicate with each other. The gas guide includes a first flow path configured to guide a portion of a gas that has passed through the suction pipe toward the compression mechanism, and a second flow path configured to guide a remaining portion of the gas that has passed through the suction pipe toward the gas flow path.

4 Claims, 6 Drawing Sheets

(56) References Cited

FOREIGN PATENT DOCUMENTS

| | | |
|---|---|---|
| JP | 2004-218536 A | 8/2004 |
| JP | 2018-131910 A | 8/2018 |

OTHER PUBLICATIONS

European Search Report of corresponding EP Application No. 21 86 6511.5 dated Dec. 14, 2023.
International Search Report of corresponding PCT Application No. PCT/JP2021/030744 dated Sep. 28, 2021.

* cited by examiner

COMPRESSOR

CROSS-REFERENCE TO RELATED APPLICATIONS

This is a continuation of International Application No. PCT/JP2021/030744 filed on Aug. 23, 2021, which claims priority to Japanese Patent Application No. 2020-153506, filed on Sep. 14, 2020. The entire disclosures of these applications are incorporated by reference herein.

BACKGROUND

Technical Field

The present disclosure relates to a compressor.

Background Art

A compressor that has been known in the art includes a flow regulating member for diverting a gas sucked into a casing. A compressor of this type is described, for example, in Japanese Unexamined Patent Publication No. 2018-131910.

The compressor of Japanese Unexamined Patent Publication No. 2018-131910 includes a closed container, an electric motor element, a compression mechanism section driven by the electric motor element, a suction pipe through which a refrigerant is sucked into the closed container, and a regulating vane that diverts the refrigerant sucked through the suction pipe. A first opening through which one of two streams of the refrigerant diverted by the regulating vane passes is formed toward the compression mechanism section. A second opening through which the other stream passes is formed toward the electric motor element.

The compressor of Japanese Unexamined Patent Publication No. 2018-131910 can cool the electric motor element as well as the compression mechanism section.

SUMMARY

A first aspect of the present disclosure is directed to a compressor including a casing having a tubular shape, a compression mechanism arranged adjacent one end of the casing in the casing to compress a gas, a motor arranged adjacent another end of the casing in the casing to drive the compression mechanism, a suction pipe opening between the compression mechanism and the motor in the casing, a gas flow path formed between the motor and an inner peripheral surface of the casing, and a gas guide facing an open end of the suction pipe in the casing. The gas flow path allows an internal region of the casing adjacent one axial end of the motor and another internal region of the casing adjacent an other axial end of the motor to communicate with each other. The gas guide includes a first flow path configured to guide a portion of a gas that has passed through the suction pipe toward the compression mechanism, and a second flow path configured to guide a remaining portion of the gas that has passed through the suction pipe toward the gas flow path.

DETAILED DESCRIPTION OF EMBODIMENT(S)

An embodiment of the present disclosure will be described below with reference to the accompanying drawings. The following embodiment is a merely preferred example in nature, and is not intended to limit the scope, applications, or use of the invention.

Embodiment

1. General Configuration

A scroll compressor (1) according to an embodiment of the present disclosure is connected to a refrigerant circuit through which a refrigerant gas circulates to perform a refrigeration cycle, and compresses the refrigerant gas serving as a working fluid. The scroll compressor (1) is used, for example, in an air conditioner or a refrigeration apparatus.

Figure 1:
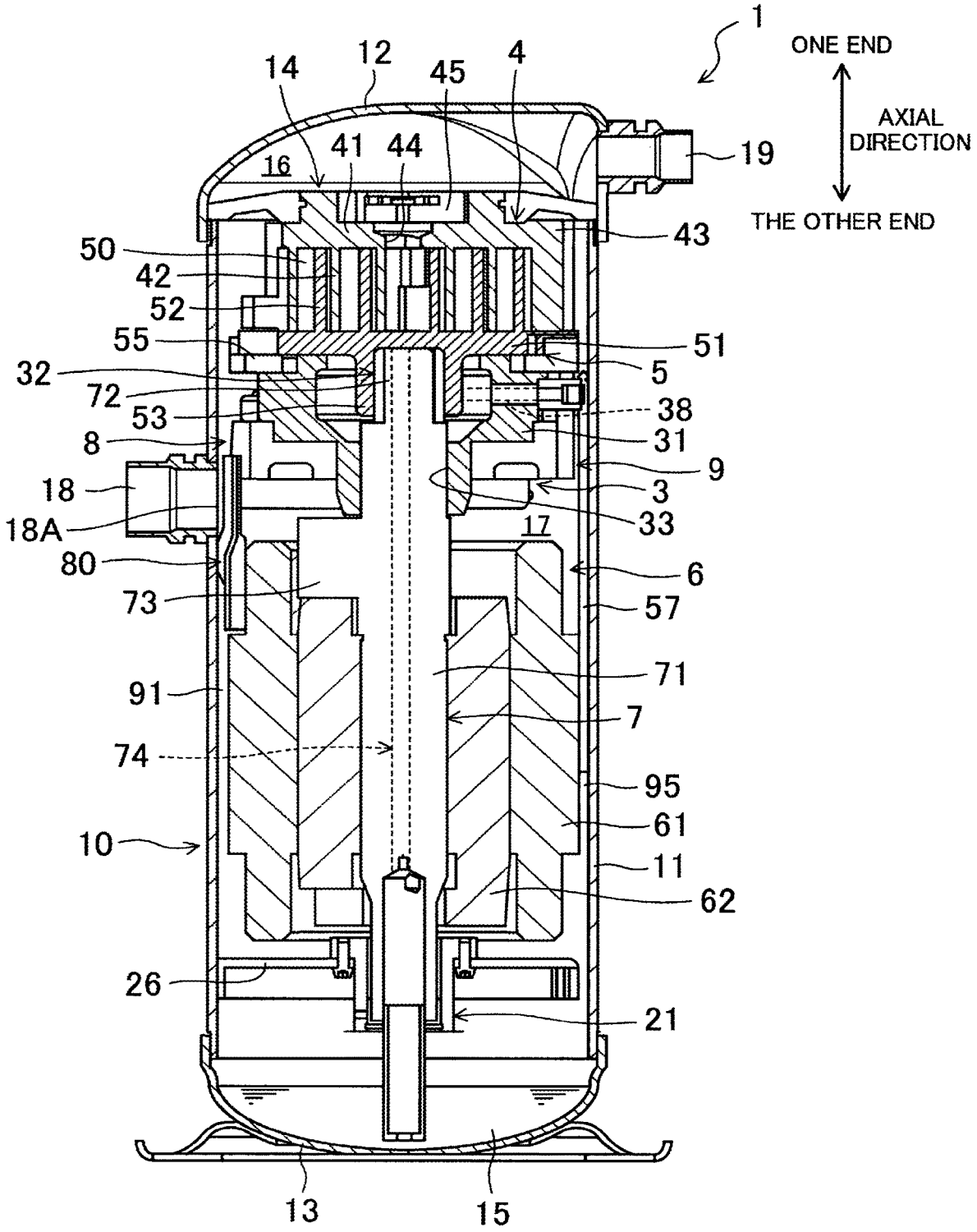
FIG. 1 is a longitudinal sectional view of a scroll compressor according to an embodiment of the present disclosure.

FIG. 1 is a longitudinal sectional view of the scroll compressor (1). As illustrated in FIG. 1, the scroll compressor (1) is a hermetic compressor, and mainly includes a casing (10), a compression mechanism (14), a motor (6), a drive shaft (7), a lower bearing (21), a partition plate (26), an suction pipe (18), and a discharge pipe (19).

The casing (10) is a closed container with both ends closed. The casing (10) has a vertically long cylindrical shape with an axis parallel to the top-to-bottom direction. The casing (10) includes a barrel (11), an upper end plate (12), and a lower end plate (13). The barrel (11) has a cylindrical shape with an axis oriented in the top-to-bottom direction. The upper end plate (12) has a convex surface protruding upward in a bowl shape. The upper end plate (12) is airtightly welded to, and integrally bonded to, an upper end portion of the barrel (11). The lower end plate (13) has a convex surface protruding downward in a bowl shape. The lower end plate (13) is airtightly welded to, and integrally bonded to, a lower end portion of the barrel (11).

The compression mechanism (14), the motor (6), the lower bearing (21), and the partition plate (26) are arranged in the casing (10). The compression mechanism (14) is arranged near an upper end of the interior of the casing (10). The motor (6) is arranged near a lower end of the interior of the casing (10). The lower bearing (21) is arranged closer to the lower end of the interior of the casing (10) than the motor (6) is. The partition plate (26) is arranged radially outside the lower bearing (21) in the casing (10). The partition plate (26) is arranged below the motor (6) in the casing (10). The drive shaft (7) is housed in the casing (10) such that the direction of its axis corresponds to the direction of the axis of the barrel (11).

As will be described in detail later, the compression mechanism (14) compresses the refrigerant gas introduced into the casing (10). The motor (6) drives the compression mechanism (14). Specifically, the motor (6) rotates the drive shaft (7), which rotates a movable scroll (5), described later, to drive the compression mechanism (14).

The casing (10) has, at its bottom, an oil reservoir (15) for storing lubricant. The partition plate (26) covers the lubricant stored at the bottom of the casing (10) from above.

The suction pipe (18) is provided for the barrel (11) of the casing (10). The suction pipe (18) introduces the refrigerant gas in the refrigerant circuit into the casing (10). The suction pipe (18) opens between the compression mechanism (14) and the motor (6) in the casing (10). The suction pipe (18) connects the inside and outside of the barrel (11) together.

The discharge pipe (19) is provided at the top of the casing (10). The discharge pipe (19) delivers the refrigerant gas compressed by the compression mechanism (14) to the refrigerant circuit. The discharge pipe (19) connects the inside and outside of the upper end plate (12) together.

The drive shaft (7) has a main shaft portion (71), an eccentric portion (72), and a counterweight portion (73). The eccentric portion (72) is relatively shorter than the main shaft portion (71). The eccentric portion is provided to extend axially from the upper end surface of the main shaft portion (71). The eccentric portion (72) has an axis decentered by a predetermined distance with respect to the axis of the main shaft portion (71). The counterweight portion (73) is provided radially outside the main shaft portion (71) so as to be dynamically balanced with the eccentric portion (72), the movable scroll (5), described later, or any other component. The drive shaft (7) has therein an oil supply channel (74) extending from the upper end to the lower end thereof. A lower end portion of the drive shaft (7) is immersed in oil in the oil reservoir (15).

The motor (6) is arranged below the compression mechanism (14) in the casing (10). The motor (6) includes a stator (61) and a rotor (62). The stator (61) is fixed to the inner peripheral surface of the barrel (11) of the casing (10) by shrink fitting or any other process. The rotor (62) is arranged radially inside the stator (61), and is fixed to the main shaft portion (71) of the drive shaft (7). The rotor (62) is arranged substantially coaxially with the main shaft portion (71). The rotor (62) is connected to the compression mechanism (14) with the drive shaft (7) interposed therebetween.

The partition plate (26) is fixed to the inner peripheral surface of the barrel (11) of the casing (10) at a location between the motor (6) and the oil reservoir (15). The partition plate (26) is generally ring-shaped as viewed in the axial direction. The lower bearing (21) is fixed in a through hole of a central portion of the partition plate (26) using a fastening means, such as a screw. The lower bearing (21) is generally cylindrical, and is arranged substantially coaxially with the partition plate (26). The lower bearing (21) rotatably supports the lower end portion of the drive shaft (7).

2. Configuration of Compression Mechanism

The compression mechanism (14) includes a housing (3), a fixed scroll (4), and the movable scroll (5). The housing (3) is fixed to an upper portion of the barrel (11) of the casing (10). The fixed scroll (4) is fixed to the upper end portion of the housing (3). The movable scroll (5) is arranged between the fixed scroll (4) and the housing (3). The housing (3) has a central portion recessed from its upper end toward its lower end in a dish shape. The housing (3) has a ring-shaped portion (31) near its outer periphery and a recessed portion (32) near its inner periphery.

A first gap (8) extending axially is formed between the outer peripheral surface of the housing (3) and the inner peripheral surface of the barrel (11) of the casing (10) at the angular position where the suction pipe (18) is arranged. The first gap (8) allows a space above the housing (3) and a space below the housing (3) to communicate with each other. A second gap (9) extending axially is formed between the outer peripheral surface of the housing (3) and the inner peripheral surface of the barrel (11) of the casing (10) at the angular position that is 180° rotationally symmetrical to the first gap (8). The second gap (9) allows the space above the housing (3) and the space below the housing (3) to communicate with each other. If no attention is paid to these gaps (8, 9), the housing (3) partitions the internal space of the casing (10) into an upper space (16) and a lower space (17).

The housing (3) has a through hole (33) passing therethrough from the bottom of the recessed portion (32) to the lower end thereof. A bearing metal (not shown) is inserted into the through hole (33). The drive shaft (7) is inserted into the bearing metal. As can be seen, the housing (3) constitutes an upper bearing that rotatably supports an upper end portion of the drive shaft (7). The housing (3) has an oil discharge passage (38) extending from the recessed portion (32) toward its outer peripheral surface and opening to the second gap (9).

The fixed scroll (4) includes a fixed end plate (41), a fixed wrap (42), and an outer peripheral wall (43). The fixed wrap (42) is in the shape of a spiral wall that draws an involute curve, and protrudes from the lower end face of the fixed end plate (41). The fixed scroll (4) is fixed to the housing (3).

The movable scroll (5) includes a movable end plate (51), a movable wrap (52), and a boss (53). The movable end plate (51) has a substantially circular flat plate shape as viewed in the axial direction. The movable wrap (52) is in the shape of a spiral wall that draws an involute curve, and protrudes from the upper end face of the movable end plate (51). The boss (53) is in a cylindrical shape extending axially, and is arranged at a center portion of the lower end face of the movable end plate (51).

The movable wrap (52) of the movable scroll (5) meshes with the fixed wrap (42) of the fixed scroll (4). The compression mechanism (14) has a compression chamber (50) surrounded by the fixed end plate (41) and the fixed wrap (42) of the fixed scroll (4) and the movable end plate (51) and the movable wrap (52) of the movable scroll (5).

A discharge port (44) passing through the fixed end plate (41) is open at the center of the fixed end plate (41) of the fixed scroll (4). A high-pressure chamber (45) is provided in the upper end face of the fixed end plate (41). The discharge port (44) is open to the high-pressure chamber (45). The high-pressure chamber (45) constitutes a high-pressure space. The high-pressure chamber (45) communicates with a space inside the upper end plate (12).

An Oldham coupling (55) is engaged in a keyway formed on the lower end face of the movable end plate (51) of the movable scroll (5) and a keyway formed on the ring-shaped portion (31) of the housing (3), and regulates the rotation of the movable scroll (5) on its own axis.

In the compression mechanism (14) having a configuration similar to that described above, energizing the motor (6) allows the drive shaft (7) to rotate the movable scroll (5). The rotation of the movable scroll (5) on its own axis is regulated by the Oldham coupling (55). Thus, the movable scroll (5) merely revolves without rotating on its own axis. The revolution of the movable scroll (5) causes the volume between the wraps (42, 52) to contract toward the center, thus compressing the refrigerant gas moving toward the center. The compressed refrigerant gas is supplied through the discharge port (44), the high-pressure chamber (45), and the discharge pipe (19) to the refrigerant circuit.

3. Detailed Configuration of Gas Guide

The scroll compressor (1) of this embodiment further includes a gas guide (80). The configuration of the gas guide (80) will be described in detail below with reference to FIGS. 1 to 5C. In the following description, directions will be defined using the axial direction, radial direction, and circumferential direction of the scroll compressor (1), based on the orientation of the gas guide (80) attached to the scroll compressor (1).

Figure 3:
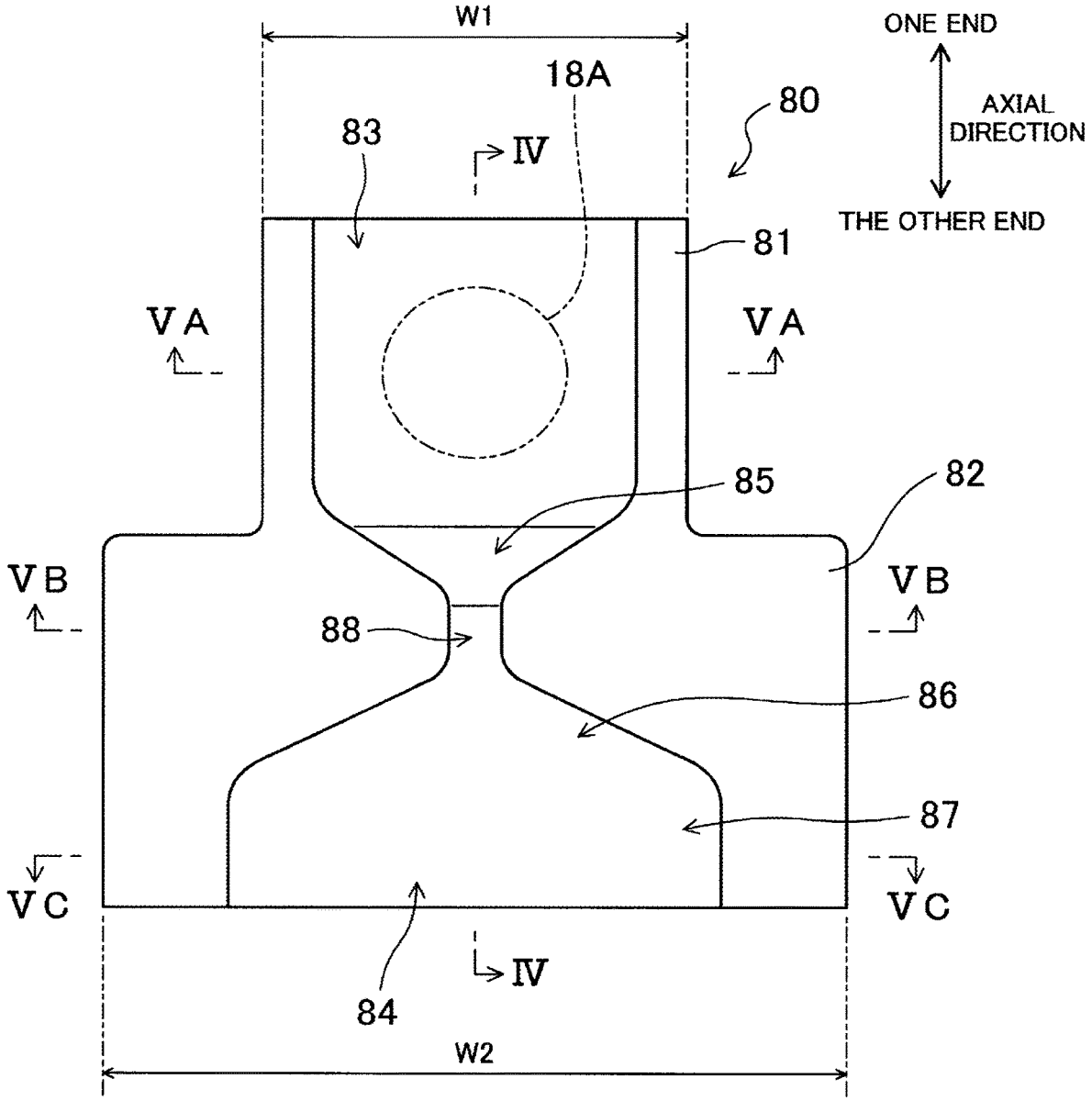
FIG. 3 illustrates the gas guide as viewed from the outside in a radial direction.

The gas guide (80) is a member for diverting (regulating the flow of) the refrigerant gas sucked from the suction pipe (18). As illustrated in FIGS. 1 and 3, the gas guide (80) is arranged to face an open end (18A) of the suction pipe (18) in the casing (10). The gas guide (80) includes a first curved surface portion (81), a second curved surface portion (82), a first flow path (83), and a second flow path (84).

The first curved surface portion (81) is in the shape of a curved surface having two circumferential ends that draw one phantom arc as viewed from the upper axial end thereof. Specifically, the first curved surface portion (81) has a curvature along the inner peripheral surface of the barrel (11) of the casing (10).

Figure 2:
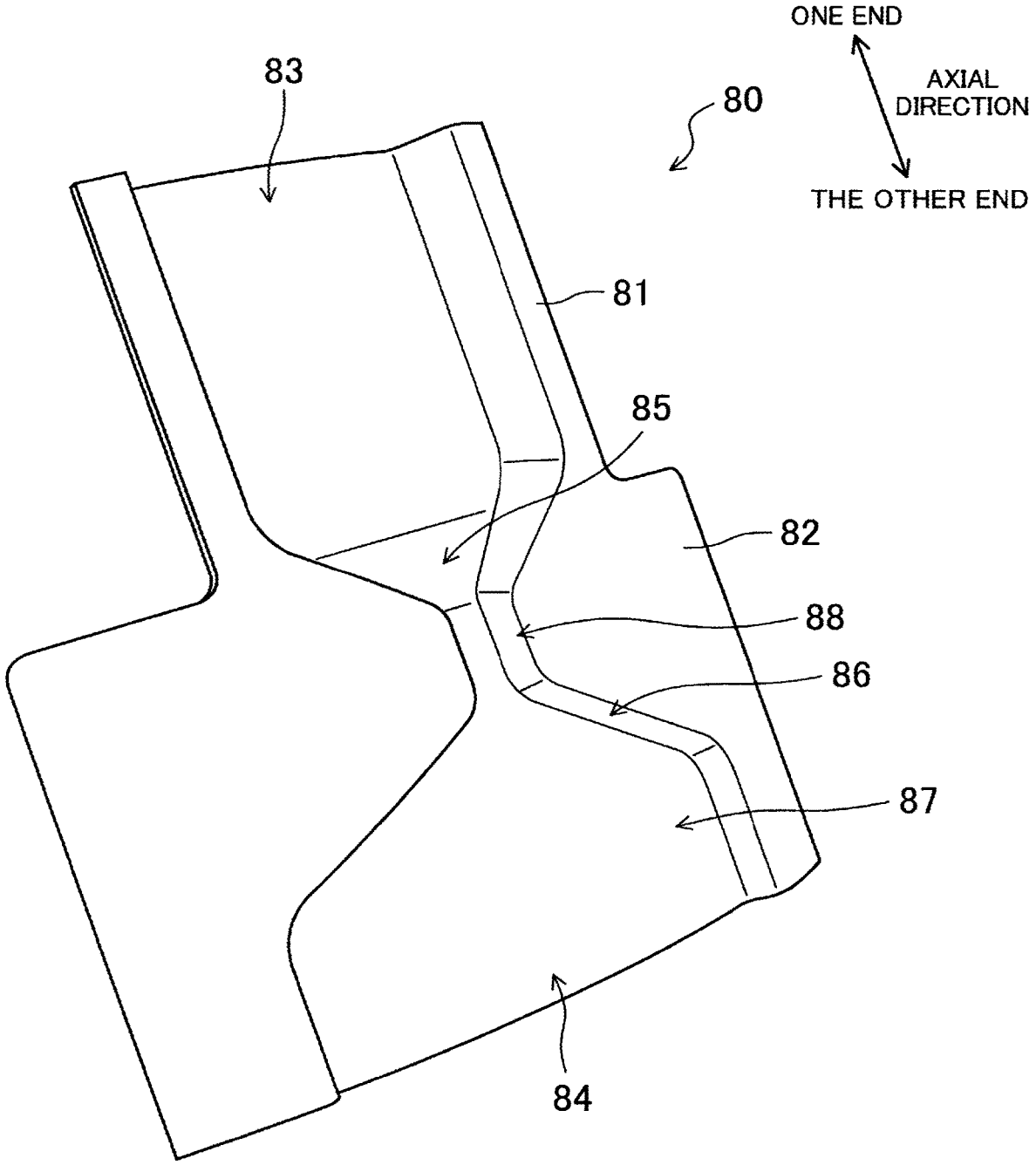
FIG. 2 is a perspective view of a gas guide.

The second curved surface portion (82) is in the shape of a curved surface having two circumferential ends that draw one phantom arc as viewed from the lower axial end thereof. Specifically, the second curved surface portion (82) has a curvature equal to that of the first curved surface portion (81). The second curved surface portion (82) is continuous with the first curved surface portion (81). A combination of these portions forms one phantom curved surface. As illustrated in FIGS. 2 and 3, the width (W2) of the second curved surface portion (82) in the circumferential direction is greater than the width (W1) of the first curved surface portion (81) in the circumferential direction (W1<W2). The centerline of the second curved surface portion (82) at the center thereof in the circumferential direction coincides with the centerline of the first curved surface portion at the center thereof in the circumferential direction.

Figure 5A:
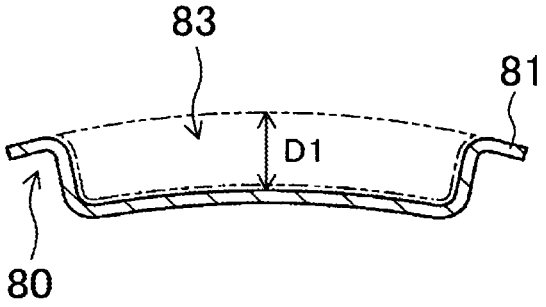
FIG. 5A is a cross-sectional view taken along line VA-VA shown in FIG. 3.

The first flow path (83) is a flow path for guiding a portion of the gas that has passed through the suction pipe (18) toward the compression mechanism (14). As illustrated in FIG. 5A, the first flow path (83) is recessed radially inward at an intermediate portion of the first curved surface portion (81) in the circumferential direction. As illustrated in FIG. 3, the first flow path (83) has a rectangular shape as viewed in the radial direction. The first flow path (83) is provided across the first curved surface portion (81) in the axial direction. The first flow path (83) is recessed radially inward by a uniform depth (D1) at any location. When the gas guide (80) is attached to the scroll compressor (1), a central portion of the first flow path (83) faces the open end (18A) of the suction pipe (18) as viewed in the radial direction.

Figure 5B:
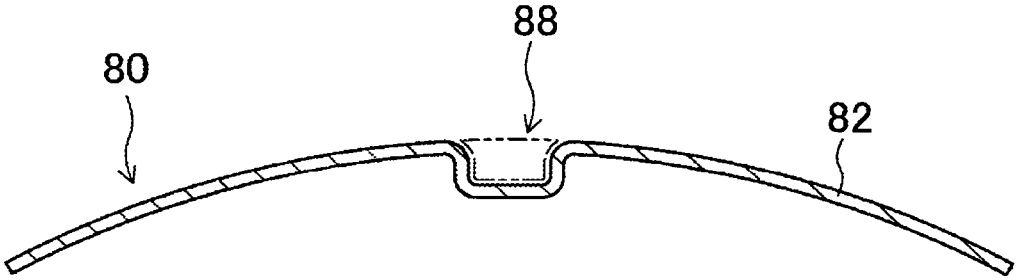
FIG. 5B is a cross-sectional view taken along line VB-VB shown in FIG. 3.
Figure 5C:
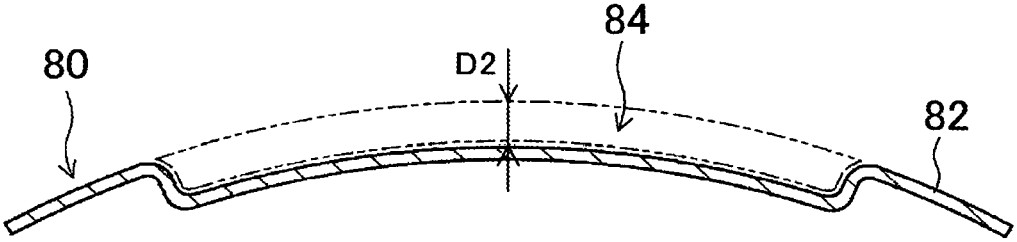
FIG. 5C is a cross-sectional view taken along line VC-VC shown in FIG. 3.

The second flow path (84) is a flow path for guiding the remaining portion of the gas that has passed through the suction pipe (18) toward the motor (6). As illustrated in FIGS. 5B and 5C, the second flow path (84) is recessed radially inward at an intermediate portion of the second curved surface portion (82) in the circumferential direction. More specifically, the second flow path (84) has a tapered portion (85), a reverse tapered portion (86), and a wide portion (87). The second flow path (84) further has a narrowed portion (88) between the tapered portion (85) and the reverse tapered portion (86).

Figure 4:
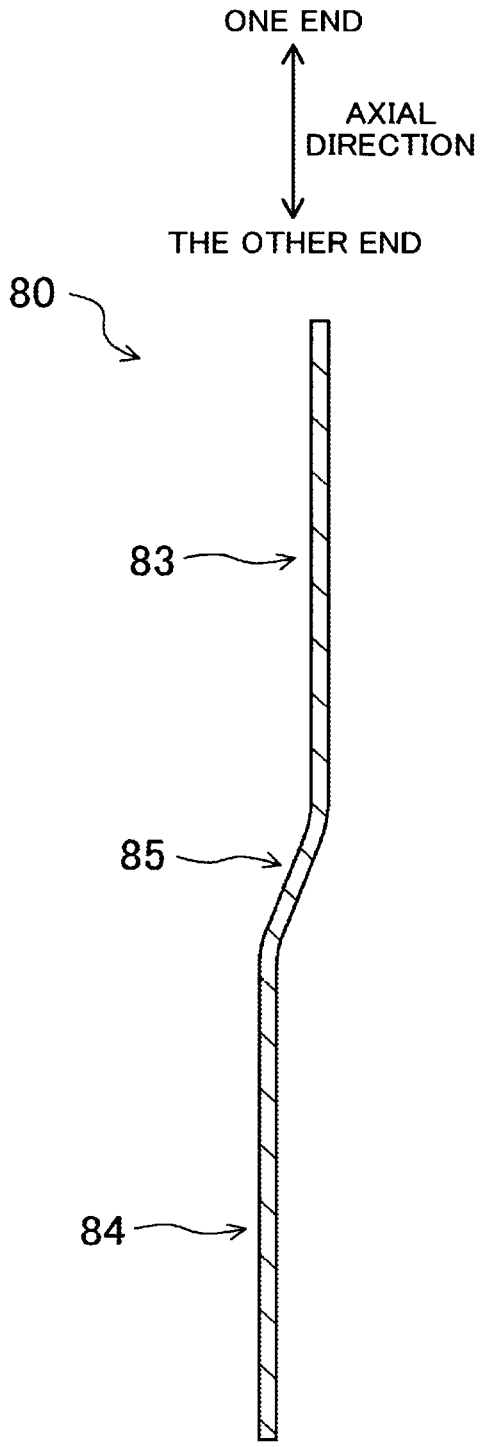
FIG. 4 is a longitudinal sectional view of the gas guide.

The tapered portion (85) has a flow path cross-sectional area that decreases toward the lower axial end thereof. As illustrated in FIG. 3, as viewed in the radial direction, the tapered portion (85) is substantially in the shape of an inverted isosceles triangle. As illustrated in FIGS. 2 and 4, the bottom of the flow path of the tapered portion (85) has a depth that decreases gradually downward. In other words, the inner surface of the tapered portion (85) in the radial direction is inclined with respect to the axial direction so as to be positioned radially outward toward the lower end thereof.

As illustrated in FIG. 3, the reverse tapered portion (86) is provided below the tapered portion (85). The reverse tapered portion (86) has a flow path cross-sectional area that increases axially downward. As viewed in the radial direction, the reverse tapered portion (86) is substantially in the shape of an isosceles triangle. As illustrated in FIG. 4, the bottom of the flow path of the reverse tapered portion (86) has a uniform depth (D2) over the entire area of the reverse tapered portion (86) (D2<D1). In other words, the inner surface of the reverse tapered portion (86) in the radial direction is parallel to the axial direction.

As illustrated in FIG. 3, the wide portion (87) is provided below the tapered portion (86) and continuously with the reverse tapered portion (86). The wide portion (87) has a rectangular shape as viewed in the radial direction. As illustrated in FIG. 4, the wide portion (87) is recessed radially inward by a uniform depth (D2) at any location. That is to say, the inner surface of the wide portion (87) in the radial direction forms an arc-shaped surface continuous with the inner surface of the reverse tapered portion (86) in the radial direction.

As illustrated in FIG. 3, the narrowed portion (88) is provided at the boundary between the tapered portion (85) and the reverse tapered portion (86). The narrowed portion (88) forms a portion having a narrowed flow path cross-sectional area. The upper end of the narrowed portion (88) is connected to the lower end of the tapered portion (85), and the lower end of the narrowed portion (88) is connected to the upper end of the reverse tapered portion (86).

Since the first flow path (83) has a uniform flow path cross-sectional area, its minimum flow path cross-sectional area is the area of a region indicated by the dashed-and-double-dotted line in FIG. 5A. Meanwhile, the second flow path (84) has a flow path cross-sectional area that varies in the axial direction, and its minimum flow path cross-sectional area is the area of a region (the narrowed portion) indicated by the dashed-and-double-dotted line in FIG. 5B.

4. Detailed Configuration of Stator

Figure 6:
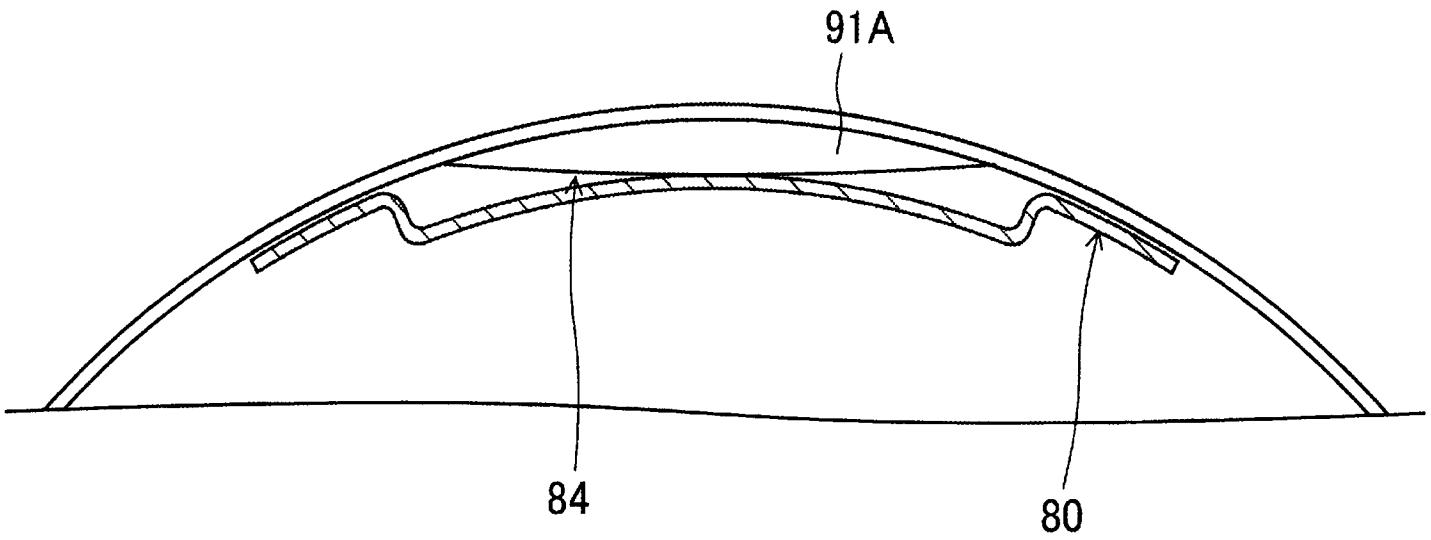
FIG. 6 illustrates the layout relationship between an outlet of a second flow path of the gas guide and a first gas flow path as viewed in an axial direction.

Details of the configuration of the stator (61) according to this embodiment will be described below with reference to FIGS. 1 and 6.

The stator (61) according to this embodiment has an outer peripheral surface with four core cuts at predetermined intervals (at intervals of 90° in this embodiment). Each core cut is formed from the upper end to the lower end of the stator (61) such that the outer peripheral surface of the stator is partially cut off. Each core cut of this embodiment forms a flat surface parallel to the axial direction. The core cuts are arranged between the outer peripheral surface of the stator (61) and the inner peripheral surface of the barrel (11) of the casing (10) to form a plurality of circulation paths extending in the top-to-bottom direction between the barrel (11) and the stator (61). The plurality of circulation paths allow an internal region of the casing (10) near one axial end of the motor (6) and another internal region of the casing (10) near the other axial end of the motor (6) to communicate with each other.

A first gas flow path (91) that is one of the plurality of circulation paths is arranged at an angular position that permits connection with the suction pipe (18) (specifically, generally directly below the suction pipe (18)), and is used to direct the flow of the sucked refrigerant gas downward to form a downward flow. An oil discharge passage (95) that is another one of the plurality of circulation paths is arranged at an angular position that is 180° rotationally symmetrical to the first gas flow path (91), and is used to allow the lubricant that has lubricated the bearings and other components through the drive shaft (7) to flow to the oil reservoir (15). In this embodiment, a guide member (57) for guiding the lubricant is arranged to extend from the above-described second gap (9) to an axially intermediate portion of the oil discharge passage (95). At least one of the second or third gas flow path that is one of the remaining two of the plurality of circulation paths is used to direct a swirl flow generated by the above-described downward flow colliding with the partition plate (26) and the rotation of the motor (6) upward to form an upward flow.

The above-described gas guide (80) is attached such that the curved surface portions (81, 82) conform to the inner peripheral surface of the barrel (11) in a condition where the first flow path (83) faces the open end (18A) of the suction pipe (18), and in a condition where the first flow path (83) has its outlet (upper end) directed toward the compression mechanism (14) and the second flow path (84) has its outlet (lower end) directed toward the motor (6). Various known methods may be used for this attachment. For example, screwing, welding, soldering, or any other method may be used. As illustrated in FIG. 6, when the gas guide (80) is attached to the scroll compressor (1), the outlet of the second flow path (84) and a first open end (91A) that is the upper end of the first gas flow path (91) face each other. As viewed in the axial direction, the outlet of the second flow path (84) covers the first open end (91A). That is to say, the first open end (91A) is surrounded by the outlet of the second flow path (84).

5. Summary

As indicated above, the scroll compressor (1) according to this embodiment includes the gas guide (80). The gas guide (80) has the first flow path (83) that guides a portion of the gas that has passed through the suction pipe (18) toward the compression mechanism (14), and the second flow path (84) that guides the remaining portion of the gas that passed through the suction pipe (18) toward the gas flow path (91). This allows a portion of the gas sucked through the suction pipe (18) to cool the motor (6) along the axial direction. As a result, the temperature difference between one axial end and the other axial end of the motor (6) decreases. This makes the temperatures of different portions of the motor (6) more uniform. This allows a temperature sensor attached to a portion of the motor (6) to accurately sense the temperature of the entire motor (6). Moreover, a single temperature sensor can accurately sense an abnormal condition, such as an excessive increase in the temperature of the motor (6). Taking an appropriate measure based on the result of this sensing can improve the reliability of the motor (6).

As illustrated in FIGS. 5A and 5B, the minimum flow path cross-sectional area of the first flow path (83) is larger than the minimum flow path cross-sectional area of the second flow path (84). This allows the gas sucked through the suction pipe (18) to flow more easily toward the compression mechanism (14) than toward the motor (6). This can prevent an adverse effect caused by the gas flowing excessively toward the motor (6).

Specifically, the gas that has flowed toward the motor (6) absorbs heat from the motor (6). Thus, its temperature increases, and its density decreases. For this reason, the higher the flow rate of the gas flowing toward the motor (6) is, the lower the density of the gas to be sucked into the compression mechanism (14) is. As a result, every time the movable scroll (5) makes one revolution, the mass of the refrigerant to be sucked by the compression mechanism (14) decreases. To address this problem, in this embodiment, setting the minimum flow path cross-sectional area of the first flow path (83) to be larger than that of the second flow path (84) limits the flow rate of the gas flowing through the motor (6). Thus, this embodiment can keep the density of the gas to be sucked into the compression mechanism (14) from decreasing to keep the efficiency of the scroll compressor (1) from decreasing, and can reduce the temperature difference between the one axial end and the other axial end of the motor (6).

In the scroll compressor (1) according to this embodiment, the second flow path (84) of the gas guide (80) has the tapered portion (85) and the reverse tapered portion (86). Thus, the second flow path (84) has the narrowed portion (88) at the joint between the tapered portion (85) and the reverse tapered portion (86). This limits the amount of the refrigerant gas flowing toward the motor (6). Spreading the refrigerant gas that has passed through the narrowed portion (88) along the surface of the reverse tapered portion (86) lowers the velocity of flow of the refrigerant gas. As a result, the velocity of flow of the gas flowing toward the motor (6) can be lowered. Just like this embodiment, for example, if the oil reservoir (15) is closer to the lower end of the casing (10) than the motor (6) for the compression mechanism (14) is, oil loss can be prevented.

Specifically, if the velocity of flow of the refrigerant gas guided by the gas guide (80) and flowing downward through the first gas flow path (91) is excessively high, the lubricant in the oil reservoir (15) may be splashed up by the gas ejected from the first gas flow path (91). The lubricant splashed up flows together with the refrigerant gas so as to be sucked into the compression mechanism (14), and flows out of the scroll compressor (1) through the discharge pipe (19) together with the refrigerant gas compressed in the compression mechanism (14). Thus, an increase in the amount of the lubricant splashed up by the refrigerant gas that has passed through the first gas flow path (91) triggers an increase in the amount of the lubricant flowing out of the scroll compressor (1), resulting in a decrease in the amount of the lubricant in the oil reservoir (15). As a result, the compression mechanism (14) or any other component may be damaged due to poor lubrication. To address this problem, in this embodiment, the gas guide (80) having the reverse tapered portion (86) reduces the velocity of flow of the gas flowing through the first gas flow path (91) to a low velocity. Thus, this embodiment can reduce the amount of the lubricant flowing out of the scroll compressor (1) to a small amount, thus maintaining the reliability of the scroll compressor (1).

In the scroll compressor (1) according to this embodiment, the outlet of the second flow path (84) of the gas guide (80) faces the first open end (91A) of the first gas flow path (91) near the gas guide. This allows the gas flowing through the second flow path (84) to flow efficiently to the first gas flow path (91).

In the scroll compressor (1) according to this embodiment, the outlet of the second flow path (84) overlaps with the entire first open end (91A) of the first gas flow path (91) as viewed in the axial direction of the casing (10). This can hinder the total amount of the refrigerant gas flowing through the second flow path (84) from flowing to the first gas flow path (91). That is to say, the gas that has flowed through the second flow path (84) can be kept from flowing excessively to the first gas flow path (91). This can prevent an adverse effect caused by the gas flowing excessively toward the motor (6).

In the scroll compressor (1) according to this embodiment, the bottom of the tapered portion (85) of the gas guide (80) is inclined radially outward toward its lower axial end. As can be seen, the plain configuration allows the minimum flow path cross-sectional area of the first flow path (83) to be larger than the minimum flow path cross-sectional area of the second flow path (84). As a result, the simple configuration allows the refrigerant gas sucked through the suction pipe (18) to flow more easily toward the compression mechanism (14) than toward the motor (6).

While the exemplary embodiment of the present invention has been described above, the present invention is not limited to the above embodiment.

In the above embodiment, the compressor is a scroll compressor. This is merely an example. Alternatively, the compressor may be a rotary compressor, a screw compressor, a sliding vane compressor, or any other type of compressor.

In the above embodiment, the axial direction of the casing (10) is directed in the top-to-bottom direction, and a so-called "vertical compressor" is used. This is merely an example. Alternatively, the compressor may be a horizontal compressor.

In the above embodiment, the line defining the boundary between the gas guide and each of the curved surface portions is straight. This is merely an example. Alternatively, the boundary between the gas guide and each of the curved surface portions may be curved. This may facilitate further smoothing the flow of the working fluid from the tapered portion to the narrowed portion and from the narrowed portion to the reverse tapered portion, for example.

In the above embodiment, the core cuts of the stator (61) are each in the shape of a flat surface formed such that the outer periphery of the stator (61) is partially cut off. This is merely an example. Alternatively, the core cuts may be each in the shape of an arc formed such that the outer periphery of the stator is partially cut away.

The elements described in the above embodiments and variations may be combined as appropriate without any contradictions.

The present disclosure is useful for a compressor.

The invention claimed is:

1. A compressor comprising:

a casing having a tubular shape;

a compression mechanism arranged adjacent one end of the casing in the casing to compress a gas;

a motor arranged adjacent another end of the casing in the casing to drive the compression mechanism;

a suction pipe opening between the compression mechanism and the motor in the casing;

a gas flow path formed between the motor and an inner peripheral surface of the casing, the gas flow path allowing an internal region of the casing adjacent one axial end of the motor and another internal region of the casing adjacent another axial end of the motor to communicate with each other; and a gas guide facing an open end of the suction pipe in the casing, the gas guide including a first flow path configured to guide a portion of a gas that has passed through the suction pipe toward the compression mechanism, and a second flow path configured to guide a remaining portion of the gas that has passed through the suction pipe toward the gas flow path, the second flow path including a tapered portion having a flow path cross-sectional area that decreases toward an outlet of the second flow path, and a reverse tapered portion closer to the outlet of the second flow path than the tapered portion, the reverse tapered portion having a flow path cross-sectional area that increases toward the outlet of the second flow path.

2. The compressor of claim 1, wherein a minimum flow path cross-sectional area of the first flow path is larger than a minimum flow path cross-sectional area of the second flow path.

3. The compressor of claim 1, wherein an outlet of the second flow path faces a first open end of the gas flow path adjacent the gas guide.

4. The compressor of claim 3, wherein the outlet of the second flow path overlaps with an entirety of the first open end of the gas flow path as viewed along an axial direction of the casing.

* * * * *